United States Patent [19]

Akay

[11] Patent Number: 4,988,369

[45] Date of Patent: Jan. 29, 1991

[54] AGGLOMERATED ABRASIVE MATERIAL, COMPOSITIONS COMPRISING SAME, AND PROCESSES FOR ITS MANUFACTURE

[75] Inventor: Galip Akay, Heswall, England

[73] Assignee: Lever Brothers Company, Division of Conopco, Inc., New York, N.Y.

[21] Appl. No.: 230,097

[22] Filed: Aug. 9, 1988

[30] Foreign Application Priority Data

Aug. 11, 1987 [GB] United Kingdom ..... 8718987

[51] Int. Cl.[5] ..... B24D 3/00

[52] U.S. Cl. ..... 51/293; 51/298; 51/308; 51/309; 252/174.23; 252/174.25

[58] Field of Search ..... 51/298, 307, 308, 293; 252/174.23, 174.24, 174.25

[56] References Cited

U.S. PATENT DOCUMENTS

| | | | |
|---|---|---|---|
| 3,955,942 | 5/1976 | Cordon et al. | 51/298 |
| 4,089,943 | 5/1978 | Roberts et al. | 51/298 |
| 4,110,083 | 8/1978 | Benedict | 51/298 |
| 4,111,666 | 9/1978 | Kalbow | 51/298 |
| 4,311,489 | 1/1982 | Kressner | 51/298 |
| 4,537,604 | 8/1985 | Dawson | 252/174.25 |
| 4,541,842 | 9/1985 | Rostoker | 51/298 |
| 4,626,364 | 12/1986 | Bauman | 252/174.25 |
| 4,652,275 | 3/1987 | Bloecher et al. | 51/298 |
| 4,799,939 | 1/1989 | Bloecher et al. | 51/298 |

FOREIGN PATENT DOCUMENTS 0104679 4/1984 European Pat. Off. .

*Primary Examiner*—William R. Dixon, Jr.
*Assistant Examiner*—Willie J. Thompson
*Attorney, Agent, or Firm*—Milton L. Honig

[57] ABSTRACT

Agglomerated abrasive material suitable for use in liquid abrasive cleaning compositions comprises inorganic filler and a polymeric binding agent selected from polyalkylenes, copolymers of polyalkylenes with each other and copolymers of polyalkylenes with up to 30% by weight of monomers containing a carboxylic acid or ester group. These agglomerates can be prepared by a process in which a melt of inorganic filler in polymeric binding agent is formed and thereafter further inorganic filler is added to the melt to raise the weight ratio of inorganic filler to binding agent above a level at which the melt spontaneously crumbles.

8 Claims, No Drawings

AGGLOMERATED ABRASIVE MATERIAL, COMPOSITIONS COMPRISING SAME, AND PROCESSES FOR ITS MANUFACTURE

BACKGROUND OF THE INVENTION

The present invention relates to agglomerated abrasive material, in particular of the polymer-agglomerated inorganic filler type, which is particularly suitable for, although not limited to, the use in liquid abrasive cleaning compositions commonly used in the household.

FIELD OF THE INVENTION

The invention also relates to processes for the manufacture of such agglomerated abrasive material, and to abrasive cleaning compositions containing such material.

THE RELATED ART

The use of agglomerated abrasive material in liquid abrasive cleaning compositions is known from e.g. European Patent Application No. 0 104 679. It has been shown that in scouring cleaning compositions application of agglomerated abrasive material provides advantages over conventional abrasive materials in that it allows the application of normally (i.e. in unagglomerated form) ineffective particle size ranges of the abrasive material and results in reduced scratching of sensitive substrate surfaces while providing effective soil removal.

In general, agglomerated abrasive material consists of two components, the basic abrasive material often of very low average particle size, and a binding agent therefor. The binding agent may be selected from a great variety of classes including resins, gums, gels, waxes and polymers.

The proper selection of the binding agent is dependent on the chemical and mechanical/physical characteristics one desires, and is often a compromise between binding capability, mechanical strength (flexural strength, micro-hardness, friability) and chemical stability under the conditions of application and storage. In particular, under the alkaline conditions of the liquid abrasive cleaner medium it has proven difficult to strike the right balance between the chemical stability and required mechanical strength.

A conventional method to manufacture agglomerated abrasive material involves the mixing of the small sized inorganic filler material and a binding agent, such as a paraffin or low molecular weight ethylene wax including a suitable degree of oxidation, to obtain a homogeneous melt, which is subsequently solidified and milled to the desired particle size range.

An alternative route, which is particularly applicable when polymeric binding agents are used, involves using solutions or emulsions of the polymeric binding agent to make a slurry with the inorganic filler material, followed by heat-drying to drive off the solvent. The cast or spray-dried solids are then milled to the desired particle size range.

It is now an object of the present invention to provide agglomerated abrasive material which is chemically and physically stable in the often alkaline liquid abrasive cleaner media, and allows a process for its manufacture which is simpler and more economical than the conventional processes, in particular in that it avoids the use of solvents and the relatively expensive steps of heat-drying and milling.

It has been found that a specific selection of polymers as binding agents, to be described in detail hereunder, results in agglomerated abrasive material which has very good physical and chemical stability, and which can be manufactured by a very simple process wherein the mixing of the two ingredients automatically results in a spontaneous crumbling process into agglomerated abrasive material the size range of which is determined by the selections and amounts of starting materials.

SUMMARY OF THE INVENTION

Accordingly, in a first aspect of the present invention, agglomerated abrasive material is provided which comprises an inorganic filler and a polymeric binding agent selected from the group consisting of the high molecular weight polyalkylenes, the copolymers thereof with each other, the copolymers thereof with up to 30% by weight of monomers containing a carboxylic acid or ester group, and the mixtures thereof.

In a second aspect, the invention provides a process for the manufacture of agglomerated abrasive material, the process comprising a first step in which a continuous melt of an inorganic filler material and a polymeric binding agent selected from the group of the high molecular weight polyalkylenes, the copolymers thereof with each other, the copolymers thereof with up to 30% by weight of monomers containing a carboxylic acid or ester group, and the mixtures thereof, and optionally a blowing agent, is prepared, the weight ratio of the inorganic filler to the polymeric binding agent being below the spontaneous crumbling level, and a second step in which sufficient inorganic filler is added to the continuous melt to raise the weight ratio of inorganic filler to polymeric binding agent above the spontaneous crumbling level.

In a third aspect, the present invention provides a scouring cleaning composition which comprises a detergent surfactant, agglomerated abrasive material and conventional scouring detergent composition adjuncts, the agglomerated abrasive material comprising an inorganic filler and a polymeric binding agent selected from the group consisting of the high molecular weight polyalkylenes, the copolymers thereof with each other, the copolymers thereof with up to 30% by weight of monomers containing a carboxylic acid or ester group, and the mixtures thereof.

DETAILED DESCRIPTION OF THE INVENTION

The selection of the inorganic filler is not very critical. Suitably, particle sizes may range from about 7 nm (currently available smallest size) up to about 10 micrometers. Particle sizes within the range of from 0.1 to 10 micrometers have been found most suitable. As particles of such smallness exhibit a reduced to non-scratching behaviour, irrespective of their hardness on Moh's scale, a wide range of inorganic fillers may be used. Thus, minerals selected from the dolomites, aragonites, feldspars, silica (sand, quartz), ground glass, the hard silicate minerals, silicon carbide, pumice, aluminas, gypsum, clays, kaolins, and the like, or mixtures thereof are all suitable basic filler materials.

Particularly suitable is calcite, for instance limestone, chalk or marble, such as those forms of calcite referred to in British Patent Specification No. 1,345,119.

An essential feature in accordance with the present invention is the selection of the polymeric binding agent. Suitable binding agents are polyalkylenes of or analogous to the high-density polyethylene (HDPE) type.

The HDPE polymers are a well-known class of relatively high molecular weight polyethylenes with no or only short-chain branching, characterised by densities within the range of from about 0.94 to 0.96 g/cm$^3$ and molecular weights of over 20,000.

Accordingly, suitable polymers in accordance with the present invention are the high-density polyethylenes, linear low-density polyethylene, low-density polyethylene, polypropylenes, polybutylenes, the copolymers thereof with each other, such as the copolymers of ethylene and propylene and/or isobutylene, and the copolymers thereof with monomers containing carboxylic groups in an amount of up to 30% by weight on polymer basis. Suitable monomers of the latter type are, in particular, the $C_2$–$C_4$ carboxylic or carboxylate monomers, such as vinyl acetate, (meth)acrylic acid and the methyl or ethyl esters thereof.

In order to have the full advantages of the present invention, the weight ratio of the inorganic filler material to the polymeric binding agent must lie above the spontaneous crumbling level of the particular combination of the filler material and the binding agent used. The spontaneous crumbling level, which is dependent on the type and size of the filler and the type and molecular weight of the polymeric binding agent, can be easily determined for each filler/binding agent combination by preparing a melt of the binding agent and slowly adding the inorganic filler material until crumbling occurs.

In general, the amount of filler may range from 10 to 97% by weight of the final agglomerate. Preferred are amounts of over 70% by weight, amounts within the range of 80 to 90% by weight being preferred most.

Accordingly, the amount of polymeric binding agent in general lies within the range of from 3 to 80% by weight of the agglomerate, preferably is below 20% by weight, the range of from 8 to 20% by weight being preferred most.

The agglomerates in accordance with the invention can be manufactured simply by preparing a melt of the polymeric binding agent and mixing in the total amount of inorganic filler material in one step.

Suitable temperatures for preparing the melt depend upon the polymeric binding agent used, but normally lie within the range of from 170° C. to 250° C., and preferably within the range of from 180° C. to 230° C.

In a particularly preferred embodiment of the present invention 50% to 80% by weight of the total amount of the inorganic filler is introduced in the first step, and 20% to 50% by weight is introduced after the continuous mixture has been achieved to effectuate the crumbling and agglomeration processes.

A significant weight fraction of the agglomerated abrasive material resulting from the process according to the present invention has a particle size within the range suitable for direct inclusion in scouring detergent products. Agglomerates which are too fine or too coarse can be removed by a simple sieving step and recycled batch-wise or continuously into a melt of the binding agent before the crumbling step. If so desired, the part of the agglomerated abrasive material which is too coarse can also be subjected to a limited milling step to reduce size.

To influence the mechanical properties of the agglomerates resulting from the process according to the invention, it may be of advantage to add in the first step of the process, i.e. the preparation of the continuous melt of the inorganic filler and the polymeric binding agent, a suitable amount of a chemical or physical blowing agent. Chemical blowing agents are those compounds which, blended with the polymeric binding agent, decompose on heating under formation of gas, thereby foaming the polymeric melt. Suitable examples are carbonate or bicarbonate salts, ethylene carbonate, organic or inorganic nitrites, aromatic or aliphatic azo compounds, hydrazine salts, hydrazides, carbonyl or sulphonyl azides. Physical blowing agents are either volatile organic liquids such as heptanes, hexanes and the like, or gasses such as $N_2$, $CO_2$ or fluorocarbons, which are injected into the polymer melt at high pressure.

Alternatively, both chemical or liquid physical blowing agents can be mixed with the filler which is subsequently blended with polymer and melted to obtain foamed polymer melt.

The blowing agent can suitably be used in amounts up to 25% by weight of the polymeric binding agent component without adversely influencing the chemical stability of the agglomerated abrasive material thus prepared. Preferably, the blowing agent is introduced into the polymer melt in an amount of from 0.5 to 15% by weight.

The agglomerated abrasive material is particularly suitable for inclusion in scouring cleaning compositions, which may be in powder or liquid form.

In such scouring cleaning compositions, generally also one or more surface-active agents are included. Suitable as surfactants in the compositions of the present invention are any of the detergent-active compounds normally used in scouring cleansers, including anionic, nonionic, cationic, zwitterionic and amphoteric compounds.

Suitable anionic surfactants are alkali metal or alkanolamine salts of $C_{12}$–$C_{18}$ branched- or straight-chain alkyl aryl sulphonates, of $C_{12}$–$C_{18}$ paraffin sulphonates, of $C_8$–$C_{12}$ branched- or straight-chain alkyl sulphonates, of $C_{10}$–$C_{18}$ alkyl $EO_{1-10}$ sulphates, of sulphosuccinates, of $C_{10}$–$C_{24}$ fatty acid soaps, etc. It is often desirable to include also a nonionic or zwitterionic detergent material, especially in the liquid type of scouring compositions. Suitable examples of nonionic detergents are water-soluble condensation products of ethylene oxide and/or propylene oxide with linear primary or secondary $C_8$–$C_{18}$ alcohols, with $C_8$–$C_{18}$ fatty acid amides or fatty acid alkylolamides (both mono- and diamides), with $C_9$–$C_{18}$ alkyl phenols and so on. The alkoxylated $C_8$–$C_{18}$ fatty mono- and dialkylolamides should contain more than one alkylene oxide unit, for instance they should be condensed with e.g. 2–5 moles of alkylene oxide such as ethylene oxide. Fatty acid mono- or dialkylolamides in which the fatty acid radical contains 10–16 carbon atoms are also suitable nonionics, such as e.g. cocofatty acid monoethanolamide. Suitable zwitterionic detergents are trialkylolamine oxides having one long alkyl chain ($C_8$–$C_{18}$) and two short alkyl chains ($C_1$–$C_4$), betaines and sulphobetaines. Other surfactants and combinations of surfactants are those referred to for use in scouring cleanser compositions described in British Patent Specification Nos. 822 569, 955 081, 1 044 314, 1 167 597, 1 181 507, 1 262 280, 1 303 810, 1 308 190, 1 345 119 and 1 418 671.

It is often desirable that scouring compositions of the present invention contain adjuncts, especially builder salts such as alkali metal silicates, carbonates, orthophosphates, pyrophosphates and polyphosphates, nitrilotriacetates, citrates, and mixtures thereof, colouring agents, perfumes, fluorescers, hydrotropes, soil-suspending agents, bleaching agents and precursors therefor, enzymes, opacifiers, germicides, humectants and salt electrolytes such as those referred to in the above patent specifications.

Particularly valuable are scouring compositions that are free-flowing powders. Such cleansers can contain from 0.1 to 40% by weight of surfactant, from 5 to 99% by weight of abrasive powder and from 0 to 95% by weight of scouring cleanser adjuncts. Also particularly valuable are scouring cleansers that are pasty or pourable aqueous liquid compositions. Such cleansers can contain from 0.1 to 50% by weight of surfactant and from 5 to 60% by weight of abrasive powder, the remainder being scouring cleanser adjuncts and water. Preferably, the abrasive powder is dispersed in the aqueous medium of the cleanser, and the aqueous medium comprises a micellar or polymeric suspending system which maintains the powder in dispersion. Suitable aqueous media are those described in British Patent Specification Nos. 1 167 597, 1 181 607, 1 262 280, 1 303 810, 1 308 190 and 1 418 671.

The invention will further be described by way of the following examples.

EXAMPLE 1

Before describing the batch and continuous processes to obtain agglomerates, it ia necessary to determine the values of the filler concentration at crumbling, $C_c$, as a function of the filler particle size for a given binder. Crumbling concentration depends on the physical and chemical nature of the binder and filler. The characteristics of the fillers are tabulated in Table 1, those of polymers and waxes are tabulated in Table 2 and those of the chemical blowing agents are tabulated in Table 3.

Determination of the crumbling concentration $C_c$ was carried out using a small Z-blade mixer in which the torque on the mixing blades could be recorded and the rotational speed of the mixer was kept at 60 rpm. After melting the polymer, small amounts of the filler were added and mixing was continued until a homogeneous melt was obtained which was reflected in increasing torque. Crumbling occurred when a homogeneous melt could no longer be obtained after the addition of a small amount of filler, and the torque was very low. Crumbling concentration was then determined.

In Table 4, crumbling concentration $C_c$ is tabulated for three different fillers and a number of waxes and polymers. The process temperature in these examples A1–A15 are the typical processing temperature for each binder.

In Table 5, the variation of the crumbling concentration $C_c$ (as volume fraction) with the filler particle size is shown for silica or calcium carbonate fillers when the binder is a HDPE. When log (particle size) is plotted against the volume fraction of the filler at crumbling, a linear relationship is obtained which can then be used to estimate the crumbling concentration for other fillers.

TABLE 1

Characteristics of the fillers

| IDENTIFYING CODE | NAME | MEAN PARTICLE SIZE (/um) |
|---|---|---|
| Aerosil 380 | Pyrogenic silica (Bet surface area = 380 $m^2/g$) | 0.007 |
| Aerosil 130 | Pyrogenic silica (Bet surface area = 130 $m^2/g$) | 0.016 |
| Aerosil TT600 | Pyrogenic silica (Bet surface area = 200 $m^2/g$) | 0.040 |
| Garosil N | Silica | 1.0 |
| Socal U3 | Precipitated calcium carbonate (99% $CaCO_3$) | 0.020 |
| Durcal 2 | Dry milled calcite (contains 1.5% $MgCO_3$) | 2.0 |
| Queensfil 10 | Dry milled calcite (95.4% $CaCO_3$) | 2.0 |
| Queensfil 25 | Dry milled calcite (95.4% $CaCO_3$) | 3.0 |
| Polcarb | Dry milled calcite (97% $CaCO_3$) | 1.0 |
| Polcarb-S | Stearate-coated version of Polcarb | 1.0 |

TABLE 2

Characteristics of the polymers and waxes used as binding agents in agglomerates

| IDENTIFYING CODE | NAME | $M_w$(1) | $T_{mp}$ (°C.)(2) |
|---|---|---|---|
| P.W. | Paraffin Wax | 500 | 60 |
| AC1702 | Polyethylene homopolymer | 1100 | 92 |
| AC617 | Polyethylene homopolymer | 1500 | 102 |
| AC735 | Polyethylene homopolymer | — | 110 |
| AC9 | Polyethylene homopolymer | 3500 | 117 |
| AC680 | Oxidised polyethylene homopolymer | 1950 | 110 |
| AC540 | Ethylene-acrylic acid copolymer with Acid Number = 40 mg KOH/g | 3000 | 108 |
| AC5120 | Ethylene-acrylic acid copolymer with Acid Number = 120 mg KOH/g | 3500 | 92 |
| AC405 | Ethylene-vinyl acetate copolymer (Vinyl acetate content = 11%) | 2000 | 96 |
| AC400 | Ethylene-vinyl acetate copolymer (Vinyl acetate content = 13%) | 3500 | 95 |
| Rigidex 140-60 | High density polyethylene (homopolymer) | $6.5 \times 10^4$ | 170 |
| Rigidex XGR791 | High density polyethylene (homopolymer) | $1.1 \times 10^5$ | 170 |
| Rigidex HO20 | High density polyethylene (homopolymer) | $3.7 \times 10^5$ | 170 |
| Hostalen GD6250 | High density polyethylene (homopolymer) | $8 \times 10^4$ | 170 |
| Lupolen 5031LX | High density polyethylene (homopolymer) | $6.4 \times 10^4$ | 170 |
| Rigidex HO60 | Ethylene-hexene-1 copolymer with one butyl branch per 1000 carbon atoms | $6.4 \times 10^4$ | 170 |
| Hostalen GUR412 | Ultra-high molecular weight homopolymer | $3 \times 10^6$ | 200 |
| UHMW 1900 | Ultra-high molecular weight homopolymer | $5 \times 10^6$ | 200 |
| GXM43 | Polypropylene | $3.9 \times 10^5$ | 200 |

(1)$M_w$ is the weight average molecular weight.
(2)$T_{mp}$ is the minimum processing temperature.

TABLE 3

| Characteristics of the chemical blowing agents | | | |
|---|---|---|---|
| NAME (GENITRON SERIES*) | EPB | EPC | EPD |
| DECOMPOSITION TEMPERATURE (°C.) | 170–200 | 160–200 | 200–220 |

*GENITRON CHEMICAL BLOWING AGENTS are based on azodicarbonamide which decomposes with the release of nitrogen, carbon monoxide, carbon dioxide and ammonia.

TABLE 4

Variation of the crumbling concentration ($C_c$) with the weight average molecular weight ($M_w$) of the continuous phase (binder) and mean primary particle size (d) the filler at various processing temperatures ($T_p$).

| Example Number | Continuous Phase (Binder) | $M_w$ | $T_p$ (°C.) | FILLER CONCENTRATION AT CRUMBLING $C_c$ (Wt. %) Durcal 2 d = 2/um | Socal U3 d = 0.02/um | Aerosil 380 d = 0.007/um |
|---|---|---|---|---|---|---|
| A1 | P.W. | 500 | 90 | 91 | — | — |
| A2 | AC1702 | 1100 | 95 | 84 | — | — |
| A3 | AC617 | 1500 | 110 | 82 | — | — |
| A4 | AC9 | 3500 | 125 | 81 | 56 | — |
| A5 | AC680 | 1950 | 120 | 81 | — | — |
| A6 | AC5120 | 3500 | 100 | 85 | — | — |
| A7 | AC405 | 2000 | 100 | 82 | — | — |
| A8 | AC400 | 3500 | 100 | 81 | — | — |
| A9 | Rigidex 140–60 | $6.5 \times 10^4$ | 180 | — | — | 46 |
| A10 | Rigidex XGR791 | $1.1 \times 10^5$ | 180 | 78 | 49 | 40 |
| A11 | Rigidex HO20 | $3.7 \times 10^5$ | 200 | — | — | 31 |
| A12 | Rigidex HO60 | $2.8 \times 10^5$ | 200 | — | — | 36 |
| A13 | Hostalen GUR412 | $3 \times 10^6$ | 240 | — | — | 16 |
| A14 | UHMW 1900 | $5 \times 10^6$ | 240 | — | — | 10 |
| A15 | GXM43 | $3.9 \times 10^5$ | 220 | — | — | 35 |

TABLE 5

Variation of the volume fraction of filler at crumbling with mean primary size when the continuous phase is Rigidex XGR 791 (high density polyethylene with $M_w = 1.1 \times 10^5$) at 180° C.

| Example Number | FILLER | PARTICLE SIZE (μm) | VOLUME FRACTION AT CRUMBLING |
|---|---|---|---|
| A16 | Aerosil 380* | 0.007 | 0.22 |
| A17 | Aerosil 130* | 0.016 | 0.28 |
| A18 | Aerosil TT600* | 0.040 | 0.32 |
| A19 | Garosil N* | 1.0 | 0.52 |
| A20 | Socal U3+ | 0.020 | 0.29 |
| A21 | Durcal 2+ | 2.0 | 0.57 |

*Silica fillers;
+Calcium carbonate fillers.

EXAMPLE 2

A number of agglomerates were prepared using the following batch method of preparation:

The batch processing was carried out in a small Z-blade mixer. The mixer was externally heated using an oil bath. The torque on the mixing blades could be recorded and the rotational speed of the blades was kept at 60 rpm. The important processing parameters were:

(1) Mean filler concentration in the product, $C_p$ (by weight;

(2) Filler concentration at crumbling, $C_c$;

(3) Processing temperature $T_p$;

(4) Processing time, $t_p$.

Polymer powder or pellets were placed in the mixer and allowed to melt, followed by homogenisation by mixing for two minutes. The addition of the filler was conducted in two different ways. These are summarised below:

1. After obtaining the homogeneous polymer melt, half of the total filler was added to the polymer melt so that at this stage the filler concentration was less than the crumbling concentration. The temperature of the mix was kept constant throughout the mixing process. When all of the polymer was mixed with the filler, the remaining filler was added. Since $C_p$ was greater than $C_c$, crumbling occurred, even though the temperature of the filler was equal to that of the mixture. The crumbling was reflected by the sudden decrease in the torque.

2. The filler was added gradually. i.e. in four stages, to the homogeneous polymer melt and subsequently mixed therewith after each addition.

When a chemical blowing agent was used, the first method of filler addition was followed. After the first addition of the filler and obtaining a homogeneous melt, the blowing agent was added while mixing was being carried out. Following the blowing action, the second half of the filler was introduced and mixing was continued until the desired mixing time was reached.

The products obtained were subsequently fractionated by sieving to obtain agglomerates with a certain size range. Table 6 tabulates the raw material characteristics, process conditions and agglomerate size distribution in batch-processed abrasives.

TABLE 6

The effect of processing conditions and raw material properties on the agglomerate size distribution in batch processing

| Example Number | RAW MATERIALS: POLYMER NAME | POLYMER Wt. % | CALCITE FILLER | BLOWING AGENT (5 wt. % polymer) | PROCESSING CONDITIONS: $T_p$ (°C.) | Time (min) | AGGLOMERATE SIZE DISTRIBUTION (μm): <45 | 45–250 | 250–1700 | >1700 | METHOD OF FILLER ADDITION |
|---|---|---|---|---|---|---|---|---|---|---|---|
| B1 | P.W. + O.P.E. | 8 | Durcal 2 | — | 90 | 120 | 6 | 16 | 65 | 13 | 2 |
| B2 | AC405 | 9 | Durcal 2 | — | 100 | 120 | — | 10 | 81 | 9 | 2 |
| B3 | AC617 | 10 | Durcal 2 | — | 110 | 120 | — | 5 | 86 | 9 | 2 |
| B4 | AC1702 | 14 | Durcal 2 | — | 95 | 120 | — | 9 | 84 | 7 | 2 |
| B5 | AC735 | 10 | Durcal 2 | — | 115 | 120 | — | 9 | 85 | 6 | 2 |
| B6 | AC5102 | 9 | Durcal 2 | — | 100 | 120 | — | 2 | 91 | 7 | 2 |
| B7 | Rigidex XGR791 | 42 | Solvay U3 | — | 200 | 120 | 15 | 27 | 34 | 24 | 2 |
| B8 | Rigidex XGR791 | 13 | Queensfil 10 | EPC | 180 | 135 | 3 | 56 | 40 | 1 | 1 |
| B9 | Rigidex XGR791 | 12 | Durcal 2 | — | 180 | 60 | 29 | 34 | 30 | 7 | 1 |
| B10 | Rigidex XGR791 | 12 | Durcal 2 | EPC | 180 | 60 | 19 | 33 | 43 | 5 | 1 |
| B11 | Rigidex XGR791 | 12 | Durcal | EPC | 180 | 100 | 15 | 41 | 40 | 4 | 1 |

EXAMPLE 3

A series of agglomerates were produced using the following continuous processing:

The continuous processing of polymer-bound agglomerates was conducted using a twin-screw extruder fitted with an additional filler feeding zone and a purpose-built outlet die. The extruder barrel and the outlet die had heating or cooling facilities. The severity of the mixing could be changed by changing the number of mixing units (paddles) in the mixer.

In all the examples, the filler and polymer were dry blended (80% filler by weight), and any blowing agent used was also added to this mixture. The resulting blend was fed into the extruder and melted while being mixed. After the first melting stage, the remaining filler was fed in cold to induce crumbling. The second mixing stage had a cooling zone at the end of the extruder.

The mixing conditions were characterised by the number of mixing elements in each mixing stage and by the temperature profile along the mixer. The product from the extruder was subsequently fed into a milling machine at temperatures ranging from 25°–100° C.

Table 7 tabulates the mixing conditions and Table 8 tabulates the various processing conditions. Tables 9 and 10 tabulate the particle size distributions before and after milling.

TABLE 7

Screw configurations and set temperatures in the heating zone

| SCREW CONFIGURATION | NUMBER OF MIXING PADDLES AFTER 1st FEED | AFTER 2nd FEED | HEATING ZONE TEMPERATURES* (°C.): 1st ZONE | 2nd ZONE | 3rd ZONE | 4th ZONE |
|---|---|---|---|---|---|---|
| 1 | 7 | 21 | 160 | 200 | 80 | 30 |
| 2 | 7 | 15 | 80 | 180 | 20 | 30 |

*Set temperature in the 2nd heating zone is 220° C. for the Examples C1 and C2.

TABLE 8

The effect of processing conditions and raw material properties on the agglomerate size distribution following milling

| Ex. No | POLYMER NAME | POLYMER CONC. (Wt. %) | FILLER | BLOWING AGENT and CONCENTRATION (Wt. %) | SCREW CONFIG. URATION (+) | OUTPUT RATE (kg/hr) | MAX. TEMP. DURING PROCESSING | PROD. TEMP. (°C.) | CRUMBLING POSSIBLE? | MILLING TEMP. (°C.) | MILLING RATE (kg/hr) | AGGLOMERATE SIZE Wt. % below 250 μm |
|---|---|---|---|---|---|---|---|---|---|---|---|---|
| C1 | Rigidex HO20 | 13 | Queensfil 25 | — | 1 | 11 | 230 | 125 | YES | — | — | — |
| C2 | Rigidex HO20 | 13 | Queensfil 25 | 5% EPD | 1 | 16 | 240 | 145 | YES | 25 | 5.2 | 80* |
| C3 | Rigidex HO20 | 11 | Queensfil 25 | — | 1 | 22 | 240 | — | YES | 25 | 7.5 | 87* |
| C4 | Rigidex HO20 | 11 | Queensfil 25 | — | 2 | 11 | 197 | 140 | YES | 100 | 6.0 | 65 |
| C5 | Rigidex HO20 | 15 | Queensfil 25 | 2% EPD | 1 | 13 | 240 | 105 | YES | 25 | 3.3 | 68* |
| C6 | Rigidex HO20 | 15 | Queensfil 25 | 2% EPD | 1 | 14 | 210 | — | YES | 25 | 3.6 | 58* |
| C7 | Rigidex HO20 | 11 | Queensfil 25 | 5% EPD | 2 | 13 | 196 | 120 | YES | 100 | 6.6 | 70 |
| C8 | Rigidex HO20 | 9 | Queensfil 25 | 5% EPD | 2 | 12 | 204 | 125 | YES | 80 | 5.0 | 70 |
| C9 | Rigidex HO20 | 14 | Durcal 2 | — | 2 | 14 | 230 | 152 | YES | 40 | 4.8 | 65 |
| C10 | Rigidex HO20 | 15 | Polcarb-S | — | 2 | 12 | 178 | 135 | Yes | 40 | 1.2 | 54 |
| C11 | Rigidex HO20 | 12 | Polcarb | — | 2 | 9 | — | 130 | YES | 40 | 3.0 | 63 |
| C12 | Lupolen 5031LX | 11 | Queensfil 25 | — | 2 | 18 | 186 | — | YES | 40 | — | 95 |

TABLE 8-continued

The effect of processing conditions and raw material properties on the agglomerate size distribution following milling

| Ex. No | POLYMER NAME | POLYMER CONC. (Wt. %) | FILLER | BLOWING AGENT and CONCENTRATION (Wt. %) | SCREW CONFIGURATION (+) | OUTPUT RATE (kg/hr) | MAX. TEMP. DURING PROCESSING | PROD. TEMP. (°C.) | CRUMBLING POSSIBLE? | MILLING TEMP. (°C.) | MILLING RATE (kg/hr) | AGGLOMERATE SIZE Wt. % below 250 μm |
|---|---|---|---|---|---|---|---|---|---|---|---|---|
| C13 | Hostalen GD6250 | 7 | Queensfil 25 | — | 2 | — | — | — | NO | — | — | — |
| C14 | Rigidex HO60 | 12 | Queensfil 25 | — | 2 | 22 | 177 | — | YES | 40 | — | 50 |
| C15 | Rigidex + HO60 + AC680 | 12 | Queensfil 25 | — | 2 | 10 | 179 | 135 | YES | 30 | 6.0 | 68 |

*In these examples, weight percent of agglomerate below 212 μm is given.
+(1) Set temperature in the second heating zone is 200° C. for the Examples B1 and B2.
(2) The size of the holes at the outlet of the extruder is 2 mm for the Examples B1 and B2. If no crumbling occurs, no screen is present at the outlet.

TABLE 9

Agglomerate size distribution in continuously processed samples before milling

| SIZE RANGE μm ↓ EXAMPLE N°→ | WEIGHT PERCENT IN EACH SIZE RANGE C1 | C2 | C3 | C4 |
|---|---|---|---|---|
| >1700 | 20.1 | 7.1 | 27.3 | 44.6 |
| 1700–1000 | 40.6 | 43.0 | 20.4 | 16.6 |
| 1000–500 | 20.5 | 25.3 | 20.6 | 17.2 |
| 500–355 | 6.4 | 7.4 | 7.6 | 6.1 |
| 355–250 | 4.8 | 6.1 | 6.3 | 5.1 |
| 250–45 | 7.4 | 10.3 | 14.8 | 9.8 |
| <45 | 0.2 | 0.6 | 0.9 | 0.6 |
| PROCESSING CHARACTERISTICS | 2 mm OUTLET SCREEN | 2 mm OUTLET SCREEN AND BLOWING AGENT | 3 mm OUTLET SCREEN | 3 mm OUTLET SCREEN LOW PROCESS TEMPERATURES |

TABLE 10

Agglomerate size distribution after milling of the coarse agglomerate obtained from the twin-screw extruder. Milling temperature is 25° C.

| SIZE RANGE μm ↓ EXAMPLE N° → | WEIGHT PERCENT IN EACH SIZE RANGE C2 | C4 | C5 | C6 |
|---|---|---|---|---|
| >212 | 19.6 | 13.0 | 32.3 | 45.3 |
| 212–200 | 4.6 | 3.3 | 7.9 | 7.2 |
| 200–150 | 15.1 | 13.6 | 15.8 | 16.6 |
| 150–100 | 21.3 | 21.0 | 17.7 | 14.3 |
| 100–75 | 11.7 | 14.6 | 7.3 | 6.9 |
| 75–63 | 6.3 | 6.0 | 5.4 | 2.5 |
| <63 | 21.4 | 28.5 | 13.6 | 7.2 |

EXAMPLE 4

Scratch and detergency (removal of 15 μm thick microcrystalline wax soil) of the agglomerates were tested using two types of liquid detergent compositions which did not contain any particulate matter for the purpose of soil removal. These compositions are in Table 11.

Detergency and scratch characteristics of the agglomerates are assessed with respect to a standard liquid abrasive detergent composition which contains 50% by weight of unagglomerated calcite with mean particle size of 17 μm, in which the particle size ranges from 10 μm to 40 μm.

BATCH PROCESSED AGGLOMERATES (a) To the freshly made STP-containing liquid detergent was added 50% by weight of the agglomerate in various narrow size range. These compositions were tested for scratching by placing approximately 10 g of the composition on a perspex sheet and rubbing against an aluminium block which is covered with a soft cloth under a weight of 1 kg. The number of oscillations was 50. The surface of the perspex sheet was then photographed for comparison with the standard liquid abrasive composition which contained 50% by weight of unagglomerated calcite filler with a mean size of 17 μm. It was found that, upon storage at 37° C. for 3 months, only the agglomerate bound by polymers was unaffected in the STP-containing liquid while the others disintegrated. Furthermore, if the unagglomerated calcite filler was used in the STP-containing liquid detergent, hard solid crystals were grown which subsequently caused extensive scratching on perspex.

(b) To the freshly made citrate-containing liquid detergent were added 25% agglomerate (within a narrow size distribution) 25% unagglomerated Durcal 2. Scratching of a perspex surface by these compositions was compared with the standard liquid abrasive composition. The results are shown in Table 12.

TABLE 11

| Composition of the liquid detergents | | |
|---|---|---|
| COMPONENTS | STP-containing liquid (Wt. %) | CITRATE-containing liquid (Wt. %) |
| Na alkylbenzene sulphonate | 3.8 | 4.95 |
| K or Na soap | 1.25 | — |
| Coconut diethanolamide | 4.45 | 6.05 |
| Sodium tripolyphosphate (STP) | 10.0 | — |
| Trisodium citrate dihydrate | — | 5.0 |
| Perfume | 0.3 | 0.4 |
| Water | Balance | Balance |

TABLE 12

Scratching characteristics of the agglomerates
In all cases the filler in the agglomerate was Durcal 2 and the batch processing time was 120 min. No blowing agent was used.

| WT PERCENT AND TYPE OF POLYMER | AGGLOMERATE SIZE RANGE (/um) | EFFECT ON PERSPEX | |
|---|---|---|---|
| | | STP-containing liquid | CITRATE-containing liquid |
| 3% Rigidex XGR791 | 75–125 | Equal | Better |
| 5.5% Rigidex XGR791 | 250–355 | Worse | — |
| 12% Rigidex XGR791 | 180–250 | — | Worse |
| 5% AC400 | 75–125 | — | Worse |
| 5% AC9 | 75–125 | Better | Worse |
| 5% AC9 | 355–500 | Worse | — |
| 13% AC1702 | 180–250 | Better | — |
| 7% AC5120 | 180–250 | Worse | — |
| 6% (P.W. + O.P.E.)* | 75–125 | — | Equal |
| 6% (AC9 + P.W.)+ | 75–125 | — | Better |
| 7% (AC9 + P.W.)+ | 180–250 | - | Equal |

*Contains 14 parts paraffin wax and 1 part oxidised polyethylene.
Contains 7 parts AC9 and 3 parts paraffin wax.

EXAMPLE 5

In this set of combined detergency and scratch tests, 50% agglomerate was mixed with 50% unagglomerated Durcal 2 and the resulting powder was added to an equal weight of the citrate-containing liquid detergent. The detergency is quantified by the number of rubs required to remove 15 micrometer thick microcrystalline wax from the perspex surface, and the results were compared with the standard liquid abrasive cleaning composition.

The results are tabulated in Table 13.

TABLE 13

Combined detergency and scratching tests for the continuously processed agglomerates after milling

| EXAMPLE N° ↓ | AGGLOMERATE SIZE RANGE (μ) | MEAN SIZE (μ) | DETERGENCY | SCRATCHING |
|---|---|---|---|---|
| STANDARD → | 10–40 | 17 | 12 | Equal |
| C2 | <212 | 104 | 9 | Much better |
| C3 | <212 | 95 | 9 | Much better |
| C5 | <212 | 119 | 9 | Slightly better |
| C6 | <212 | 122 | 9 | Slightly better |
| C4 | 75–125 | 100 | 16 | Better |
| C7 | 75–125 | 100 | 9 | Better |
| C8 | 75–125 | 100 | 14 | Equal |
| C9 | 75–125 | 100 | 11 | Better |
| C10 | 75–125 | 100 | 11 | Better |
| C11 | 75–125 | 100 | 13 | Better |
| C12 | 75–125 | 100 | 10 | Better |
| C13 | 75–125 | 100 | 11 | Better |
| C14 | 75–125 | 100 | 17 | Better |
| C15 | 75–125 | 100 | 11 | Better |

I claim:

1. A process for the manufacture of agglomerated abrasive material, the process comprising a first step of forming a continuous melt of an inorganic filler material and a polymeric binding agent selected from the group of the high molecular weight polyalkylenes, the copolymers thereof with each other, the copolymers thereof with up to 30% by weight of monomers containing a carboxylic acid or ester group, and the mixtures thereof, and a second step of adding further inorganic filler to the continuous melt in a sufficient amount to raise the weight ratio of inorganic filler to polymeric binding agent above a level at which the melt spontaneously crumbles into particles comprising said filler agglomerated and coated by said binding agent.

2. A process as claimed in claim 1 wherein 50 to 80% by weight of the total amount of the inorganic filler is introduced in said first step.

3. A process as claimed in claim 1 wherein said first step is carried out at a temperature within the range from 170° C. to 250° C.

4. A process as claimed in claim 1 wherein said first step includes addition of a blowing agents selected from the group consisting of carbonate and bicarbonate salts, ethylene carbonate, organic and inorganic nitrites, aromatic and aliphatic azo compounds, hydrazine salts, hydrazides, and carbonyl and sulphonyl azides.

5. A process as claimed in claim 1 wherein said first step includes incorporation into the melt of a volatile liquid as blowing agent.

6. A process as claimed in claim 1 wherein said first step includes incorporation of a gaseous blowing agent into the melt.

7. A process according to claim 4 wherein the amount of said blowing agent is from 0.5 to 15% by weight of the polymeric binding agent.

8. A process according to claim 5 wherein the amount of said blowing agents is from 0.5 to 15% by weight of the polymeric binding agent.

* * * * *